US010901354B2

(12) United States Patent
Notoya et al.

(10) Patent No.: US 10,901,354 B2
(45) Date of Patent: Jan. 26, 2021

(54) FIXING MEMBER, FIXING DEVICE, AND ELECTROPHOTOGRAPHIC IMAGE FORMING APPARATUS

(71) Applicant: CANON KABUSHIKI KAISHA, Tokyo (JP)

(72) Inventors: Yasuharu Notoya, Tokyo (JP); Yohei Miyauchi, Tokyo (JP); Kimihiro Yoshimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/351,994

(22) Filed: Mar. 13, 2019

(65) Prior Publication Data

US 2019/0294090 A1 Sep. 26, 2019

(30) Foreign Application Priority Data

Mar. 22, 2018 (JP) ..... 2018-055191
Feb. 20, 2019 (JP) ..... 2019-028560

(51) Int. Cl.
*G03G 15/20* (2006.01)

(52) U.S. Cl.
CPC ..... *G03G 15/2057* (2013.01); *G03G 15/206* (2013.01); *G03G 2215/2048* (2013.01)

(58) Field of Classification Search
CPC ..... G03G 15/20–15/2064
See application file for complete search history.

(56) References Cited

U.S. PATENT DOCUMENTS

| | | | | |
|---|---|---|---|---|
| 6,895,206 | B2 | 5/2005 | Nakamura et al. | |
| 9,250,546 | B2 | 2/2016 | Kameyama et al. | |
| 9,575,439 | B2 | 2/2017 | Tsuji | |
| 2007/0110993 | A1 | 5/2007 | Pickering | |
| 2013/0302074 | A1 | 11/2013 | Lee et al. | |
| 2014/0321893 | A1 | 10/2014 | Qi et al. | |
| 2016/0223967 | A1 | 8/2016 | Mukoyama et al. | |
| 2018/0155569 | A1* | 6/2018 | Pham | C09D 5/031 |

FOREIGN PATENT DOCUMENTS

| | | | |
|---|---|---|---|
| JP | 9-096981 | A | 4/1997 |
| JP | 2003-029484 | A | 1/2003 |
| JP | 2004-053847 | A | 2/2004 |

(Continued)

OTHER PUBLICATIONS

Y. Kitazaki et al., "Extended Fowkes' Equation and Evaluation of Surface Tension of Polymer Solid," 8(3) J. Adhes. Soc. Jpn. 131-141 (1972).

(Continued)

*Primary Examiner* — Ramsey Zacharia
(74) *Attorney, Agent, or Firm* — Venable LLP

(57) ABSTRACT

Provided is a fixing member in which hot offset of a toner is difficult to be generated. The fixing member has a substrate and a release layer as a surface layer, wherein the release layer includes PFPE and a second fluororesin, the second fluororesin being at least one selected from PFA and FEP, and in a $^{19}$F-NMR spectrum of the release layer measured at a temperature of 200° C., a relaxation time T1 of longitudinal relaxation of a peak derived from PFPE is 0.5 seconds or more and 3.5 seconds or less.

10 Claims, 6 Drawing Sheets

(56) References Cited

FOREIGN PATENT DOCUMENTS

| | | | |
|---|---|---|---|
| JP | 2015-028613 | A | 2/2015 |
| JP | 2015-212810 | A | 11/2015 |
| JP | 2018-001109 | A | 1/2018 |
| JP | 2018-180488 | A | 11/2018 |

OTHER PUBLICATIONS

Extended European Search Report in European Application No. 19164105.9 (dated Sep. 6, 2019).
Extended European Search Report in European Application No. 19164106.7 (dated Sep. 5, 2019).
Miyauchi et al., U.S. Appl. No. 16/351,974, filed Mar. 13, 2019.

* cited by examiner

FIXING MEMBER, FIXING DEVICE, AND ELECTROPHOTOGRAPHIC IMAGE FORMING APPARATUS

BACKGROUND OF THE INVENTION

Field of the Invention

The disclosure is generally directed to a fixing member, a fixing device including the fixing member, and an electrophotographic image forming apparatus including the fixing device.

Description of the Related Art

In general, in a fixing device used for an electrophotographic image forming apparatus (hereinafter, also referred to as "image forming apparatus") such as a copying machine or a laser printer, rotating bodies such as a pair of a heated roller and a roller, a film and a roller, a belt and a roller, and a belt and another belt are contacted with pressure. In addition, a recording medium such as paper holding an image formed by an unfixed toner is introduced into a pressure contacted portion (hereinafter, referred to as "fixing nip portion") formed between the rotating bodies, and an unfixed toner is heated and melted, such that the image is fixed on the recording medium. The rotating body with which the unfixed toner image on the recording medium is in contact is called a fixing member, and is called a fixing roller, a fixing film, and a fixing belt depending on a form thereof.

In order to suppress adhesion of the toner, as a release layer (hereinafter, referred to as "release layer") constituting an outer surface of the fixing member, a release layer including a fluororesin may be used. The fluororesin is, specifically, for example, a tetrafluoroethylene/perfluoroalkyl vinyl ether copolymer (hereinafter, also referred to as "PFA"). However, as an image forming speed has increased in recent years, it has been proposed to make a surface temperature of the fixing member higher. In this case, it cannot be determined that releasability of the toner on the outer surface of the fixing member provided with the release layer including PFA is sufficient.

Japanese Patent Application Laid-Open No. 2015-028613 suggests that a perfluoropolyether (hereinafter, also referred to as "PFPE") in a state of high molecular mobility is contained in an outermost layer in order to suppress adhesion of a toner with respect to an outer surface of an electrophotographic member such as a photoconductor and an intermediate transfer body.

As a result of review by the present inventors, when the electrophotographic member according to Japanese Patent Application Laid-Open No. 2015-028613 is used as a heating member of a thermal fixing device, toner releasability on the outer surface is deteriorated due to long-term use, and thus a hot offset of the toner may occur at the time of thermal fixation.

SUMMARY OF THE INVENTION

An embodiment of the present disclosure is directed to providing a fixing member in which hot offset of a toner is hardly generated even by long-term use. Another embodiment of the present disclosure is directed to providing a fixing device that contributes to stable formation of a high quality electrophotographic image. Still another embodiment of the present disclosure is directed to providing an electrophotographic image forming apparatus capable of forming a high-quality electrophotographic image.

According to an embodiment of the present disclosure, there is provided a fixing member for electrophotography including:

a substrate; and a release layer as a surface layer, wherein the release layer includes a first fluororesin and a second fluororesin, the first fluororesin being perfluoropolyether (PFPE), the second fluororesin being at least one selected from a tetrafluoroethylene-perfluoroalkyl vinyl ether copolymer (PFA) and a tetrafluoroethylene-hexafluoropropylene copolymer (FEP), and wherein, when a longitudinal relaxation time of PFPE in a form of a simple substance derived from a $^{19}$F-NMR measured at a temperature of 200° C. is defined as T1−1, and a longitudinal relaxation time of PFPE contained in the release layer derived from a $^{19}$F-NMR of the release layer measured at a temperature of 200° C. is defined as T1−2, T1−1, and T1−2 satisfy a relationship represented by Equation (1) below:

$$[(T1-1)-(T1-2)]/(T1-1)\geq 0.1. \quad \text{Equation (1)}$$

According to another embodiment of the present disclosure, there is provided a fixing device including the fixing member.

According to still another embodiment of the present disclosure, there is provided an electrophotographic image forming apparatus including the fixing device.

Further features of the present disclosure will become apparent from the following description of exemplary embodiments with reference to the attached drawings.

DESCRIPTION OF THE EMBODIMENTS

Figure 1A:
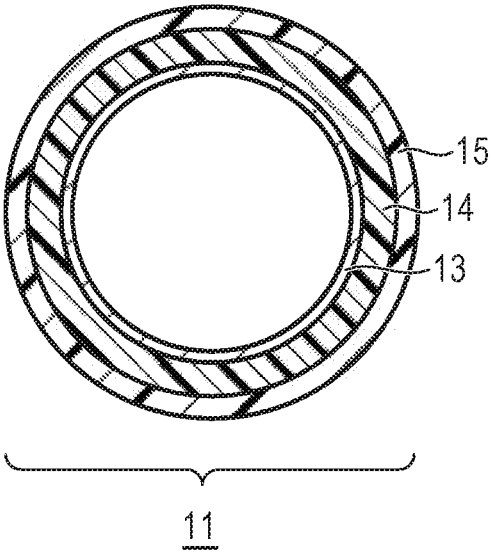
FIG. 1A is a schematic cross-sectional view of a fixing belt according to an embodiment of the present disclosure.

Preferred embodiments of the present disclosure will now be described in detail in accordance with the accompanying drawings.

The present inventors presume the reason that hot offset of a toner is easily generated when an electrophotographic member according to Japanese Patent Application Laid-Open No. 2015-028613 is used as a heating member of a thermal fixing device, is as follows. In other words, in the thermal fixing device, a temperature of the heating member is high, for example, 200° C. or more. Therefore, the molecular mobility of PFPE included in the outermost layer of the electrophotographic member according to Japanese Patent Application Laid-Open No. 2015-028613 excessively increases, and thus an amount of PFPE leaching to the outer surface increases. The PFPE on the outer surface is physically removed by the contact between the recording medium carrying the toner or the toner image and the release layer, and the PFPE in the outermost layer is depleted in a relatively short time. As a result, it is considered that the toner is easily adhered to the outer surface, which generates hot offset.

Therefore, the present inventors repeated the study with a purpose of obtaining a fixing member, which is difficult to generate the hot offset of the toner even by long-term use, by suppressing leaching of PFPE to the outer surface at a high temperature such as 200° C.

As a result, the present inventors found that the above-described object can be achieved by containing PFPE into the release layer as the outermost layer in a state of suppressing the molecular mobility.

That is, the fixing member according to an embodiment of the present disclosure includes a substrate and a release layer as a surface layer. In addition, the release layer includes a first fluororesin and a second fluororesin.

The first fluororesin is perfluoropolyether (PFPE). In addition, the second fluororesin is at least one selected from a tetrafluoroethylene-perfluoroalkyl vinyl ether copolymer (PFA) and a tetrafluoroethylene-hexafluoropropylene copolymer (FEP).

In addition, when a longitudinal relaxation time of PFPE in a form of a simple substance derived from a $^{19}$F-NMR thereof measured at a temperature of 200° C. is defined as T1–1, and a longitudinal relaxation time of the PFPE contained in the release layer derived from a $^{19}$F-NMR of the release layer measured at a temperature of 200° C. is defined as T1–2, T1–1 and T1–2 satisfy a relationship represented by Equation (1) below:

$$[(T1-1)-(T1-2)]/(T1-1)\geq 0.1 \qquad \text{Calculation Equation (1)}$$

Relaxation in NMR means that nucleus excited by receiving an electromagnetic wave emits energy and returns to a ground state. This relaxation has spin-lattice relaxation called longitudinal relaxation and spin-spin relaxation called transverse relaxation. This relaxing process is defined by a time constant called relaxation time. In particular, the longitudinal relaxation time T1 correlates with the molecular mobility. For example, in a polymer compound, as the longitudinal relaxation time T1 measured at a temperature sufficiently higher than a glass transition temperature of the corresponding polymer compound is longer, the molecular mobility of the corresponding polymer compound is higher. For example, PFPE is liquid at room temperature (23° C.) and a temperature of 200° C. is sufficiently higher than the glass transition temperature.

In addition, when the longitudinal relaxation time T1 of PFPE in a form of a simple substance, i.e., PFPE having no limitation on molecular mobility, derived from 19F-NMR thereof measured at a temperature of 200° C. is determined as (T1–1) seconds, and the longitudinal relaxation time T1 of the PFPE contained in the release layer derived from 19F-NMR of the release layer measured at a temperature of 200° C. is determined as (T1–2) seconds, both relaxation times (T1–1) and (T1–2) satisfy the relationship expressed by the above Calculation Equation (1), which means that the molecular mobility of PFPE contained in the release layer is significantly suppressed.

In the $^{19}$F-NMR of the release layer measured at a temperature of 200° C., the longitudinal relaxation time (T1–2) of the PFPE contained in the release layer is, for example, 0.5 seconds or more and 3.5 seconds or less, and particularly preferably 0.5 seconds or more and 2.0 seconds or less.

As the second fluororesin for controlling the molecular mobility of PFPE, for example, at least one selected from PFA and FEP can be suitably used. The reason is that it is difficult for PFA and FEP to lower the toner releasability of the outer surface of the release layer even when PFA and FEP are contained in the release layer.

The longitudinal relaxation time (T1–1) of PFPE in a form of a simple substance can be derived from $^{19}$F-NMR using an NMR apparatus (for example, "400 WB" manufactured by Agilent Technologies Japan, Ltd.) according to the following methods.

First, PFPE is analyzed under dry air (for example, relative humidity 50%) atmosphere under the following measurement conditions.

Measurement Conditions

Measurement item: $^{19}$F

Observation frequency: 376.81 MHz

Probe: diameter of 4.0 mm

Rotational speed: 0 kHz

Standard material of chemical shift: hexafluorobenzene (−163 ppm)

(1) $^{19}$F-NMR spectrum measurement

Measurement method: Single pulse method

Measurement temperature: 28° C.

(2) $^{19}$F-NMR longitudinal relaxation time (T1) measurement

Measurement method: inversion recovery method (180°-τ-90°)

Measurement temperature: 200° C.

Figure 5:
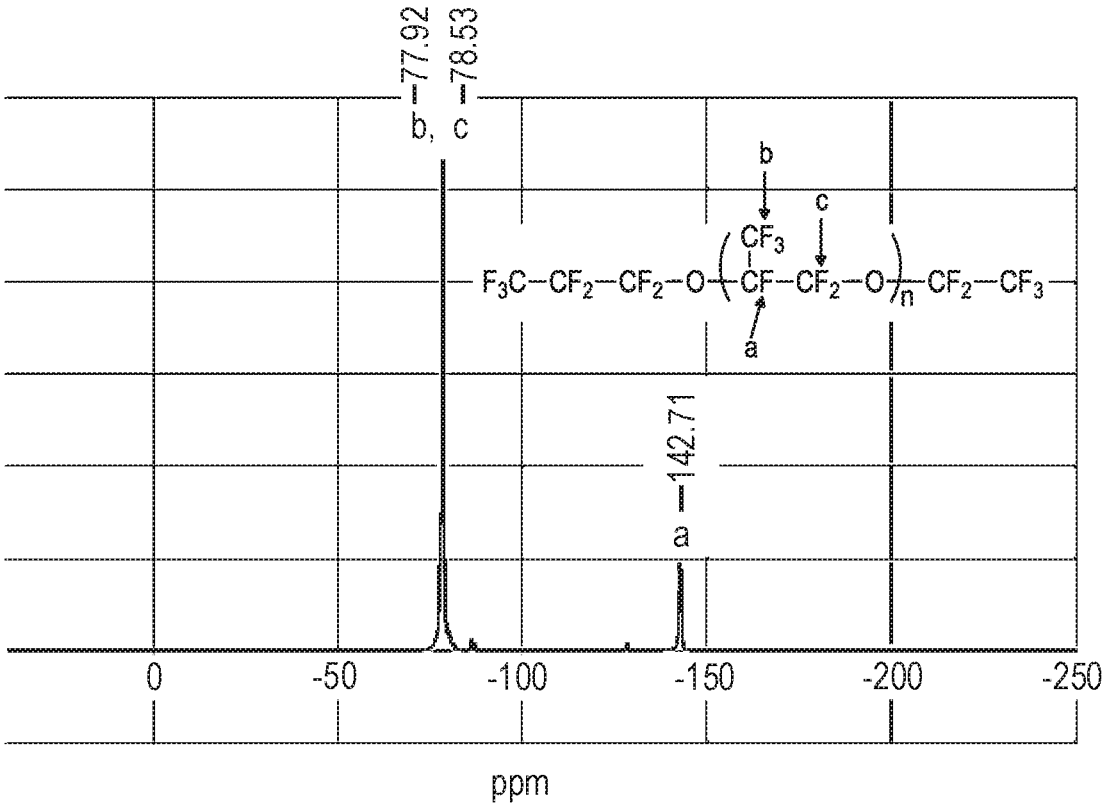
FIG. 5 is a chart of a $^{19}$F-NMR spectrum of a PFPE in a form of a simple substance.

In the measurement of (1) above, a $^{19}$F-NMR spectrum of a PFPE in a form of a simple substance, is obtained by internal processing of the NMR apparatus. From the obtained $^{19}$F-NMR spectrum, a peak derived from PFPE can be attributed. As an example, FIG. 5 shows a $^{19}$F-NMR spectrum of polyperfluoroisopropyl ether (PFPE) in a form of a simple substance and results attributed thereto.

In the measurement of (2) above, a high frequency magnetic field pulse is applied to the measurement specimen at a pulse width of 180 degrees, and then after the waiting time τ elapses, a high frequency magnetic field pulse is further applied at a pulse width of 90° to obtain a free induction decay (FID) signal. The obtained FID signal is subjected to Fourier transformation by the internal processing of the NMR apparatus, and the $^{19}$F-NMR spectrum of the PFPE in a form of a simple substance is obtained. Here, each signal intensity A(τ) derived from PFPE, which is obtained from the $^{19}$F-NMR spectrum, is expressed by the following Calculation Equation (1):

$$A(\tau)=A_0(1-2\exp(-\tau/T1)) \qquad \text{Calculation Equation (1)}$$

Here, $A_0$ is a saturation value of the intensity of each peak derived from PFPE. T1 is a longitudinal relaxation time of each peak.

In addition, the measurement of (2) above is performed by changing the waiting time τ at least four times, preferably eight times or more, for a time sufficient for all the peaks to reach the saturation value (five times or more of the relaxation time T1, for example, 20 to 100 seconds) or less. As a result, at least four FID signals are obtained, and at least four $^{19}$F-NMR spectra are obtained from the corresponding FID signals.

Subsequently, each of the peaks attributed to PFPE in each spectrum is plotted on a graph with the waiting time τ on the horizontal axis and the signal intensity on the vertical axis. Based on at least four plots on the graph, curve fitting is performed by the least squares method based on Calculation Equation (1) by the internal processing of the NMR apparatus to obtain $A_0$ and T1.

Then, the largest value among the at least four T1s derived from the at least four $^{19}$F-NMR spectra is taken as T1–1.

A simple substance PFPE sample for measuring (T1–1), the molecular structure of PFPE in the release layer may be analyzed by a known analysis method such as NMR or PFPE having the same molecular structure may be used as a sample.

In addition, PFPE in the release layer may be extracted by the following method and the extracted PFPE may be used as a sample. An example of a specific extraction method is described below. First, a release layer is collected from the fixing member. As a method for collecting the release layer from the fixing member, the release layer is cut together with the elastic layer, then the elastic layer is dissolved and removed with a resin dissolving agent such as "e-solve series" (manufactured by Kaneko Chemical Co., Ltd.), and only the release layer is taken out. The collected release layer may be subjected to pulverization treatment in order to increase extraction efficiency of PFPE.

Subsequently, the collected release layer is immersed in a solvent capable of dissolving PFPE (for example, 1,1,1,2,2,3,4,5,5,5-decafluoro-3-methoxy-4-(trifluoromethyl)-pentane) and placed at a temperature of 25° C. for 24 hours. Thus, PFPE in the release layer is eluted in the solvent.

Next, the solvent from which the PFPE is eluted and the release layer are separated by filtration, and the solvent is removed from the solvent from which the PFPE is eluted using an evaporator from the obtained filtrate, thereby obtaining PFPE. In addition, 1,1,1,2,2,3,4,5,5,5-decafluoro-3-methoxy-4-(trifluoromethyl)-pentane is commercially available as "NOVEC 7300" (Product name; manufactured by 3M Co., Ltd.).

Further, the longitudinal relaxation time (T1–2) of PFPE contained in the release layer can be derived from a $^{19}$F-NMR spectrum of the release layer by using an NMR apparatus (for example, "400 WB" manufactured by Agilent Technologies Japan, Ltd.) according to the following methods.

First, a sample for measurement of the release layer is collected. As a method for collecting the measurement sample of the release layer from the fixing member, there are a method for cutting out a measurement sample from the release layer, and a method for cutting out a part of the release layer together with the elastic layer, and dissolving and removing the elastic layer with a resin dissolving agent "e-solve series" (manufactured by Kaneko Chemical Co., Ltd.) to obtain the measurement sample.

Subsequently, the measurement sample is analyzed under dry air (for example, relative humidity 50%) atmosphere under the following measurement conditions.

Measurement Conditions

Measurement item: $^{19}$F

Observation frequency: 376.81 MHz

Probe: diameter of 4.0 mm

Rotational speed: 10 kHz

Standard material of chemical shift: hexafluorobenzene (−163 ppm)

(3) $^{19}$F-NMR spectrum measurement

Measurement method: Single pulse method

Measurement temperature: 28° C.

(4) $^{19}$F-NMR longitudinal relaxation time (T1) measurement

Measurement method: inversion recovery method (180°-τ-90°)

Measurement temperature: 200° C.

Figure 6:
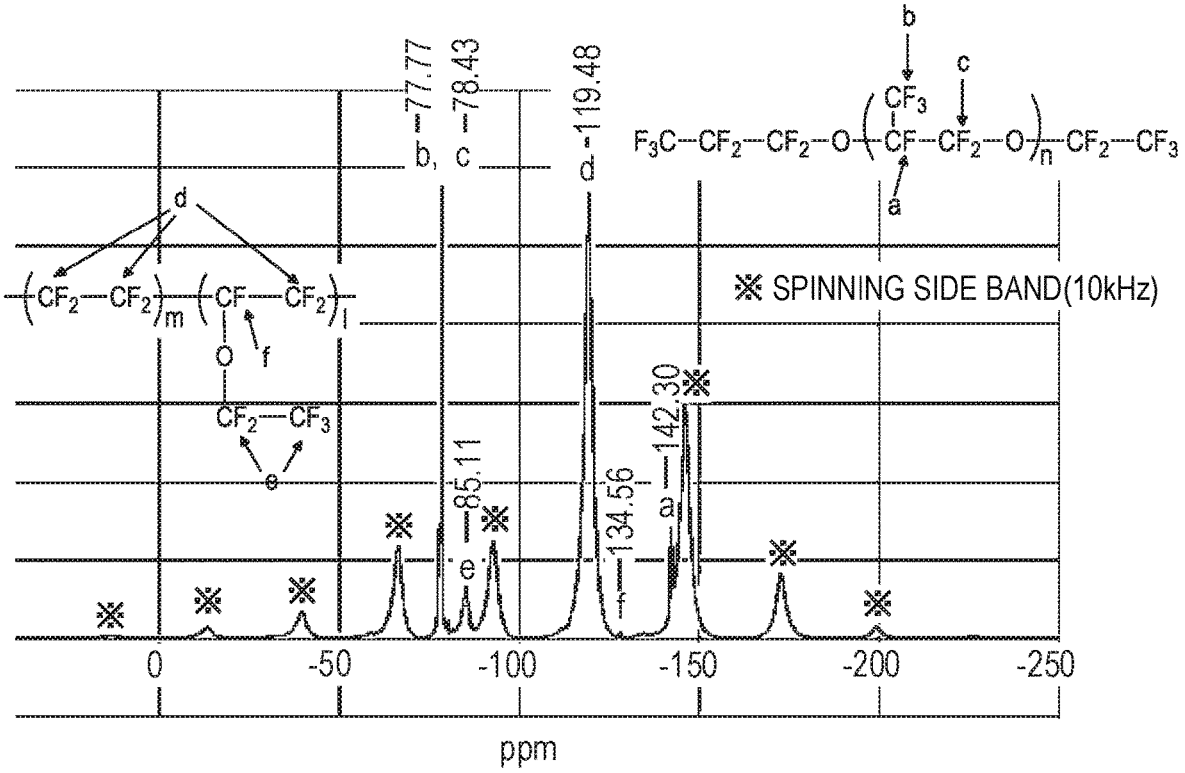
FIG. 6 is a chart of a $^{19}$F-NMR spectrum of a sample taken from a release layer.

In the measurement of (3) above, a $^{19}$F-NMR spectrum of the measurement sample is obtained by internal processing of the NMR apparatus. From the obtained $^{19}$F-NMR spectrum, a peak derived from PFPE is attributed. As a method for attribution, the peak may be determined based on the peak attributed from the $^{19}$F-NMR spectrum obtained with respect to the above described PFPE in a form of a simple substance. Further, the peak position predicted according to the repeating unit of PFPE shown below may be attributed by reference. As an example, the $^{19}$F-NMR spectrum of the release layer including polyperfluoroisopropyl ether (PFPE) and PFA and the attribution results are shown in FIG. 6.

PFPE has a repeating unit of perfluoroalkylene ether. In addition, examples of the perfluoroalkylene ether may include perfluoromethyl ether, perfluoroethyl ether, perfluoropropyl ether, and perfluoroisopropyl ether.

Accordingly, in the peak derived from PFPE in $^{19}$F-NMR, a signal is observed at the following positions depending on the structure of the repeating unit.

Perfluoromethyl ether: −50 to −55 ppm;

Perfluoroethyl ether: −86 to −91 ppm;

Perfluoropropyl ether:

Peaks derived from $CF_2$ adjacent to oxygen: −80 to −85 ppm,

Peaks derived from $CF_2$ which is not adjacent to oxygen: −125 ppm to −130 ppm;

Perfluoroisopropyl ether:

Peaks derived from —$CF_3$, $CF_2O$—: −77 to −82 ppm,

Peaks derived from fluorine bonded to carbon to which trifluoromethyl group is bonded: −141 to −146 ppm In the measurement of (4) above, a high frequency magnetic field pulse is applied to the measurement specimen at a pulse width of 180 degrees, and then after the waiting time τ elapses, a high frequency magnetic field pulse is further applied at a pulse width of 90° to obtain a free induction decay (FID) signal. The obtained FID signal is subjected to Fourier transformation by the internal processing of the NMR apparatus, and the $^{19}$F-NMR spectrum of the release layer is obtained. Here, each signal intensity A(τ) derived from PFPE in the release layer, which is obtained from the $^{19}$F-NMR spectrum, is expressed by Calculation Equation (1) above.

In addition, the measurement of (4) above is performed by changing the waiting time τ at least four times, preferably eight times or more, for a time sufficient for all the peaks to reach the saturation value (for example, 20 to 100 seconds) or less. As a result, at least four FID signals are obtained, and at least four $^{19}$F-NMR spectra are obtained from the corresponding FID signals.

Next, each of the peaks attributed to PFPE in each spectrum is plotted on a graph with the waiting time τ on the horizontal axis and the signal intensity on the vertical axis. Based on at least four plots on the graph, curve fitting is performed by the least squares method based on Calculation Equation (1) by the internal processing of the NMR apparatus to obtain $A_0$ and T1.

Then, the largest value among the at least four T1s derived from the at least four $^{19}$F-NMR spectra is taken as T1–2.

The suppression of the molecular mobility of PFPE in the release layer can be achieved, for example, by containing a second fluororesin different from PFPE (first fluororesin) in the release layer so that the second fluororesin interacts with the polymer chain of PFPE. In addition, the fixing member including this release layer can be obtained, for example, through the following steps.

(Step 1) Pellets of the second fluororesin are stirred and mixed with PFPE to obtain a mixture.

(Step 2) The mixture is melt-kneaded and extruded at a temperature of a melting point (280° C. to 320° C.) or more of the second fluororesin and 450° C. or less using a twin-screw extruder to obtain a melt-kneaded product of the second fluororesin and PFPE (hereinafter, referred to as "second fluororesin/PFPE melt-kneaded product").

(Step 3) The second fluororesin/PFPE melt-kneaded product is pelletized, and the pellets are extrusion-molded into a tube shape with an extrusion molding machine to obtain a tube for a release layer.

(Step 4) An outer surface of an elastic layer formed on the substrate is coated with the tube for a release layer.

Here, when a release layer is formed using a mixture of PFPE and a second fluororesin without performing the (Step 2), it is difficult to suppress the molecular mobility of PFPE in the release layer at a temperature of 200° C. In other words, it is difficult to determine the relaxation time T1 of the longitudinal relaxation of PFPE to 3.5 seconds or less. In other words, it is assumed that the release layer including PFA and PFPE can be manufactured using a coating system that mixes during atomization by using, for example, two spray guns. Here, one of the spray guns is filled with a PFA dispersion liquid and the other one is filled with a high molecular weight PFPE, and PFA and PFPE are simultaneously sprayed onto the substrate while adjusting spray amounts so as to be predetermined amounts, thereby forming a coating film including PFA and PFPE. Then, the coating film is fired at a temperature exceeding the melting point of PFA to obtain a release layer including PFA and PFPE. A change rate ([(T1−1)−(T1−2)/(T1−1)]) between the longitudinal relaxation time (T1−2) of PFPE contained in the release layer and the longitudinal relaxation time (T1−1) of PFPE in a form of a simple substance is less than 0.1, and the molecular mobility of PFPE in the release layer is hardly suppressed. As a result, it is difficult to maintain stable toner releasability over a long period of time.

Hereinafter, the fixing member according to an embodiment of the present disclosure is described in detail based on specific configurations.

1. Fixing Member

Figure 1B:
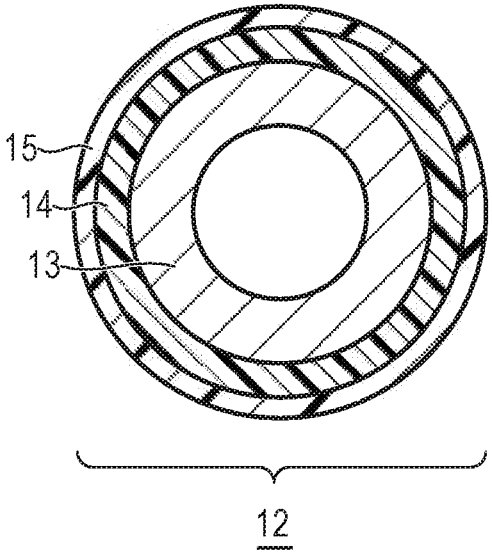
FIG. 1B is a schematic cross-sectional view of a fixing roller according to an embodiment of the present disclosure.

A fixing member according to an embodiment of the present disclosure is described with reference to FIGS. 1A and 1B. FIG. 1A is a cross-sectional view taken in a direction parallel to a circumferential direction of an endless belt-shaped fixing member (hereinafter, also referred to as "fixing belt") 11. Further, FIG. 1B is a cross-sectional view taken in a direction parallel to a circumferential direction of a roller-shaped fixing member (hereinafter, also referred to as a "fixing roller") 12.

The fixing members 11 and 12 include a substrate 13, an elastic layer 14 coating a surface of the substrate, and a release layer 15 coating a surface of the elastic layer.

The release layer 15 may be fixed to the surface of the elastic layer 14 as an adhesive layer which is not shown. In addition, the elastic layer 14 is not an essential constituent element, but the substrate 13 and the release layer on the surface of the substrate 13 may be installed directly or via the adhesive layer.

(1) Substrate

As a material of the substrate 13, a metal such as aluminum, iron, stainless steel, or nickel, an alloy thereof, and a heat-resistant resin such as polyimide are used.

In the fixing roller, for example, a hollow shaped or solid mandrel is preferably used as the substrate. As a material of the mandrel, a metal such as aluminum, iron, or stainless steel or an alloy thereof may be included. When the hollow mandrel is used, it is possible to install a heat source inside.

In the fixing belt, a substrate having an endless belt shape is used as the substrate 13. As the material of the substrate, for example, materials having excellent heat resistance such as nickel, stainless steel, and polyimide may be included. A thickness of the substrate is not particularly limited, but for example, preferably 20 to 100 μm, from the viewpoints of strength, flexibility, and heat capacity.

A surface treatment may be performed to an outer surface of the substrate 13 in order to impart adhesiveness to the elastic layer 14. For the surface treatment, it is possible to use one or a combination of a plurality of physical treatments such as blasting, lapping, and polishing, and a chemical treatment such as an oxidation treatment, a coupling agent treatment, and a primer treatment.

When the elastic layer including silicone rubber is installed on the surface of the substrate, it is preferable to apply a primer treatment to the surface of the substrate in order to improve adhesiveness between the substrate and the elastic layer. Examples of a primer used for the primer treatment may include a coating material in which a silane coupling agent, a silicone polymer, hydrogenated methylsiloxane, alkoxysilane, a reaction promoting catalyst, or a coloring agent such as red iron oxide is properly blended and dispersed in an organic solvent.

The primer may be appropriately selected depending on the material of the substrate, the type of the elastic layer, or a form of a cross-linking reaction. In particular, in order to impart adhesiveness by reaction with the unsaturated aliphatic group, when the elastic layer includes a large amount of unsaturated aliphatic groups, a primer containing a hydrosilyl group is preferably used, and when the elastic layer includes a large amount of hydrosilyl groups, a primer containing an unsaturated aliphatic group is preferably used. In addition thereto, as the primer, primers containing an alkoxy group may also be included.

As the primer, a commercially available product may be used. Further, the primer treatment includes a step of applying the primer to a surface of the substrate (a surface to be adhered to the elastic layer), followed by drying or firing.

(2) Elastic Layer

As a material constituting the elastic layer, it is preferable to use a heat-resistant rubber such as a silicone rubber or a fluorine rubber. Among them, an addition-curing type silicone rubber is preferable.

A thickness of the elastic layer may be appropriately designed in consideration of surface hardness of the fixing member and a width of a nip to be formed. When the fixing member has a belt shape, a thickness of the elastic layer is preferably 100 μm or more and 500 μm or less, and more preferably 200 μm or more and 400 μm or less.

Further, when the fixing member has a roller shape, the thickness of the elastic layer is preferably 100 μm or more and 3 mm or less, and more preferably 300 μm or more and 2 mm or less. By determining the thickness of the elastic layer within this range, a sufficient nip width can be secured by deformation of the substrate when the fixing member is incorporated in the fixing device.

The elastic layer may include a filler. The filler is added in order to control thermal conductivity, heat resistance, and an elastic modulus. Specifically, examples of the filler may include silicon carbide (SiC), silicon nitride ($Si_3N_4$), silica ($SiO_2$), boron nitride (BN), aluminum nitride (AlN), alumina ($Al_2O_3$), iron oxide ($Fe_2O_3$), zinc oxide (ZnO), magnesium oxide (MgO), titanium oxide ($TiO_2$), copper (Cu), aluminum (Al), silver (Ag), iron (Fe), nickel (Ni), carbon black (C), carbon fiber (C), carbon nanotube (C), and the like.

In addition, in the elastic layer, a reaction control agent (inhibitor) called an inhibitor for controlling a reaction start time may be blended. Known materials such as methylvinyltetrasiloxane, acetylene alcohols, siloxane-modified acetylene alcohol, hydroperoxide are used as the reaction control agent.

(3) Release Layer

In addition, the release layer includes a first fluororesin and a second fluororesin.

In addition, the first fluororesin is perfluoropolyether (PFPE), and the second fluororesin is at least one selected from a tetrafluoroethylene-perfluoroalkyl vinyl ether copolymer (PFA) and a tetrafluoroethylene-hexafluoropropylene copolymer (FEP).

In addition, the longitudinal relaxation time (T1–2) of PFPE contained in the release layer may preferably be 0.5 seconds or more and 3.5 seconds or less, and more preferably be 0.5 seconds or more and 2.0 seconds or less.

<PFA>

Examples of PFA may include a copolymer of tetrafluoroethylene and at least one selected from perfluoromethyl vinyl ether [$CF_2{=}C(F){-}O{-}CF_3$], perfluoroethyl vinyl ether [$CF_2{=}C(F){-}O{-}CF_2CF_3$], and perfluoropropyl vinyl ether [$CF_2{=}C(F){-}O{-}CF_2CF_2CF_3$].

When perfluoroalkyl vinyl ether (hereinafter, also referred to as PAVE) in PFA is contained in an amount of about 1 mol % to 5 mol % in the molecular chain, it is preferable since a resin viscosity of at the time of melt-kneading can be lowered. Further, when the amount is about 3 mol % to 5 mol %, it is more preferable since the resin viscosity at the time of melt-kneading may be lowered and the interaction with PFPE is also enhanced.

Further, a melt flow rate (MFR) of PFA is 1.0 g/10 min or more and 10.0 g/10 min or less, particularly, 1.5 g/10 min or more and 3.0 g/10 min or less from the viewpoint of controllability of the molecular motion of PFPE in the release layer and enhancement of the interaction with PFPE at the time of melt-kneading. In addition, the MFR of PFA is a value measured according to Method A of JIS K 7210-1:2014 at a temperature of 372° C. under a load of 5 kgf using a standard die.

As PFA, commercially available products can be used, and specific examples are provided as follows.

"451 HP-J", "959 HP-Plus", "350-J", and "950 HP-Plus" (all products manufactured by Du Pont Mitsui Fluorochemicals Co., Ltd.)

"P-66 P", "P-66 PT", and "P-802 UP" (all products manufactured by AGC Inc.)

"AP-230", "AP-231 SH", and the like (all products manufactured by Daikin Industries, Ltd.)

"6502 N" (product manufactured by 3M Company).

<FEP>

FEP is a copolymer of tetrafluoroethylene and hexafluoropropylene, and it is preferable that hexafluoropropylene is contained in the molecular chain in an amount of about 1 mol % to 15 mol % from the viewpoint of lowering the viscosity at the time of melt-kneading and enhancing the interaction with PFPE.

The MFR of FEP is preferably 1.0 g/10 min or more and 10.0 g/10 min or less, and particularly preferably 1.5 g/10 min or more and 3.0 g/10 min or less in the same measurement method as PFA.

As FEP, commercially available products can be used, and specific examples are provided as follows.

"100-J", "130-J", "140-J", and the like (all products manufactured by Du Pont Mitsui Fluorochemicals Co., Ltd.)

"NP-20", "NP-30", and the like (all products manufactured by Daikin Industries, Ltd.)

"6301N", and the like (product manufactured by 3M Company).

<PFPE>

Perfluoropolyether (PFPE) is a polymer having a perfluoroalkylene ether as a repeating unit. Specific examples of the perfluoroalkylene ether may include perfluoromethyl ether, perfluoroethyl ether, perfluoropropyl ether, and perfluoroisopropyl ether.

From the viewpoint of heat resistance, the perfluoroalkylene ether having a number average molecular weight of 5,000 or more and 100,000 or less, particularly 7,000 or more and 30,000 or less, may be preferably used.

From the viewpoint of heat resistance, PFPE, which has a chemical structure in which the constituent atoms are only carbon atoms, fluorine atoms, and oxygen atoms, and these atoms are bonded by a single bond, is preferable. In addition, among PFPE, a content of perfluoromethyl ether is more preferably low, and is preferably 1 mol % or less. This is because a fluorocarbon structure adjacent to oxygen has low heat resistance and tends to be a starting point for thermal decomposition.

Further, PFPE having at least one of the structures represented by the Structural Formula (1) below and Structural Formula (2) below in the molecule can be more preferably used. In other words, PFPE having this structure in the molecule can better control the relaxation time (T1–2) in the NMR spectrum at a temperature of 200° C. in the release layer. It is considered that the reason is because structures according to Structural Formulas (1) and (2) are similar to a structure of the polyalkylene vinyl ether which is a covalent bond moiety in PFA, and thus polymer chains tend to interact with each other.

Structural Formula (1)

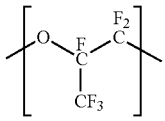

Structural Formula (2)

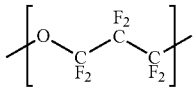

Specific examples of PFPE that can be used are listed below. However, the present disclosure is not limited thereto.

PFPE having a structure represented by Structural Formula (3) (for example, "Demnum S200" and "Demnum S100" (all products manufactured by Daikin Industries, Ltd.):

$$F_3C{-}CF_2{-}CF_2{-}O{-}(CF_2{-}CF_2{-}CF_2{-}O{-})_nCF_2CF_3$$

Structural Formula (3)

PFPE having a structure represented by Structural Formula (4) (for example, "Krytox GPL107", "Krytox GPL106", "Krytox 143AD", "Krytox VPF16256", "Krytox XHT-750" and "Krytox XHT-1000" (all products manufactured by Chemours Company):

Structural Formula (4)

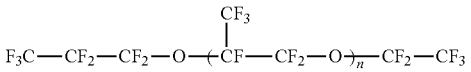

PFPE having a structure represented by Structural Formula (5) (for example, "Fomblin M60" and "Fomblin M30" (all products manufactured by Solvay Japan, Ltd.):

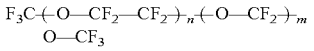

Structural Formula (5)

In order to maintain excellent toner releasability of the outer surface of the release layer and to suppress excessive leaching into the outer surface at high temperature, the release layer preferably contains PFPE in a proportion of 1 mass % or more and 30 mass % or less, and particularly preferably 3 mass % or more and 20 mass % or less, based on the total amount of PFA and PFPE.

<Thickness of Release Layer>

A thickness of the release layer is preferably 3 μm or more and 100 μm or less, and further preferably 10 μm or more and 50 μm or less. This is because it is easy to form a release layer having a thickness of 3 μm or more, and when the thickness of the release layer is 100 μm or less, heat transfer from the fixing member to the paper is good.

<Manufacturing Method of Fixing Member>

A manufacturing method of the fixing belt according to the present embodiment is described below.

<<Preparation of Fluororesin Tube for Release Layer>>

First, a fluororesin tube for a release layer is prepared by a method described in the following steps 1 to 3.

(Step 1) A first fluororesin, i.e., PFPE, is stirred and mixed with a second fluororesin pellet to obtain a mixture.

(Step 2) The mixture is extruded while melt-kneading at a temperature equal to or higher than a melting point of the second fluororesin using a twin-screw extruder to obtain a melt-kneaded product of the second fluororesin and PFPE.

(Step 3) The melt-kneaded product is pelletized, and the pellets are extrusion-molded into a tube shape with an extrusion molding machine to obtain a tube for a release layer.

(Step 1)

The pellets of the second fluororesin and PFPE are stirred and mixed in a predetermined stirrer at a predetermined ratio to obtain a mixture of the second fluororesin and PFPE. Stirring conditions herein are not particularly limited, but for example, the pellets of the second fluororesin are subjected to pulverization treatment, or the like, in advance, and then stirred and mixed with PFPE, which is preferable since a contact area between the second fluororesin and PFPE increases, and it is easy to further enhance the interaction with PFPE at the time of melt-kneading.

(Step 2)

The pellets of the mixture obtained in Step 1 are injected into a twin-screw extruder, heated to a temperature equal to or higher than a melting point of the second fluororesin, and kneaded under predetermined conditions while melting the second fluororesin to obtain a melt-kneaded product of the second fluororesin and PFPE.

For example, when PFA is used as the second fluororesin, PFA can be melted by heating to a temperature of, for example, 350 to 420° C. Further, when FEP is used as the second fluororesin, for example, FEP can be melted by heating to 300 to 370° C.

As kneading conditions, for example, when a diameter of a screw of the twin-screw extruder is 46 mm, kneading is performed at a screw rotation speed of 100 to 600 rpm.

Since both the first fluororesin and the second fluororesin have low surface free energy, it was considered that it is difficult to mix polymer chains of PFA or FEP so that the polymer chains can interact with PFPE. However, by kneading the second fluororesin in molten state together with PFPE under strong shearing, PFPE could be mixed with the second fluororesin without phase separation. It is considered that PFA and FEP in the molten state also include a crystal region and are loosed in the molecular chain. In this state, due to similarity in molecular structure, PFPE having high chemical affinity, and PFA or FEP exist in an entirely or partially compatible state. Therefore, even at a high temperature such as 200° C., it is considered that PFPE realizes a state that PFPE is chemically and stably included in PFA without phase separation from PFA and FEP.

(Step 3)

The melt-kneaded product obtained in Step 2 is pelletized, and the pellets are extruded into a tube shape using an extrusion molding machine to mold a fluororesin tube for forming a release layer.

In a state where PFPE is mixed with PFA in a molten state, since the melt viscosity is lower than that in a state where only PFA is melted, it is possible to set a heating temperature to be lower rather than extruding a melt of PFA alone.

Therefore, the heating temperature of the melt-kneaded product in the present step is preferably 340° C. to 400° C. when the melt-kneaded product is a melt-kneaded product with PFA.

Further, in the case of a melt-kneaded product with FEP, the heating temperature is preferably 300° C. to 360° C.

<<Manufacture of Fixing Member>>

(Step 4) includes a step of coating an outer peripheral surface of the elastic layer coating an outer peripheral surface of a substrate having endless belt-shape with the fluororesin tube obtained in (Step 3). Here, on the outer peripheral surface of the elastic layer, an adhesive layer may be installed in advance.

2. Fixing Device

In the fixing device, rotating bodies such as a pair of a heated roller and a roller, a film and a roller, a belt and a roller, and a belt and another belt are contacted with pressure, and are appropriately selected in consideration of conditions such as an entire process speed, size, and the like, of the electrophotographic image forming apparatus. Here, a specific example of the fixing device is described and a configuration thereof is described.

(1) Fixing Device Using Fixing Belt

Figure 2:
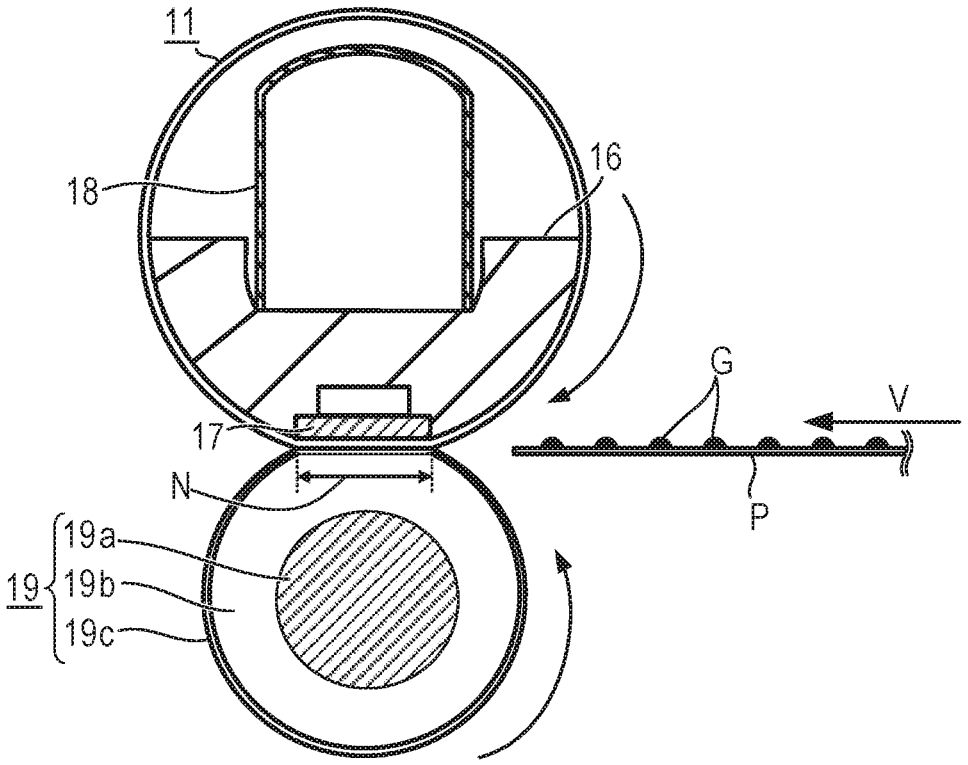
FIG. 2 is a schematic cross-sectional view of a fixing device using a fixing belt according to an embodiment of the present disclosure.

FIG. 2 is a transverse cross-sectional schematic view showing an example of a fixing device according to an embodiment of the present disclosure, the fixing device including a fixing belt; and a heating unit according to an embodiment of the present disclosure.

In the fixing device, the fixing belt 11 is a seamless fixing belt as a fixing member according to an embodiment of the present disclosure. In order to maintain the fixing belt 11, a belt guide member 16 molded with a resin having heat resistance and heat insulating properties is disposed.

A ceramic heater 17 as a heat source constituting a part of the heating unit of the corresponding fixing device is provided at a position where the belt guide member 16 and an inner surface of the fixing belt 11 are in contact with each other.

The ceramic heater 17 is engaged and fixed in a groove portion formed and provided along a longitudinal direction of the belt guide member 16. The ceramic heater 17 is electrically conducted by a unit, which is not shown, to generate heat.

The seamless fixing belt 11 is loosely fitted to the belt guide member 16. A rigid stay for pressurizing 18 is inserted into the inside of the belt guide member 16.

In an elastic pressure roller 19 as a pressure member, an elastic layer 19*b* of silicone rubber is installed on a stainless steel mandrel 19*a* to lower surface hardness.

Both end portions of the stainless steel mandrel 19*a* are rotatably disposed by bearing hold between a front side and a chassis side plate inside, which are not shown, in the device.

The elastic pressure roller 19 is coated with a fluororesin tube having a thickness of 50 μm, as a surface layer 19*c* in order to improve surface property and releasability.

Each pressurizing spring (not shown) is compressed between both end portions of the rigid stay for pressurizing 18 and a spring receiving member (not shown) at the device chassis side to apply a force pressing downward to the rigid stay for pressurizing 18. Thus, a lower surface of the ceramic heater 17 disposed on the lower surface of the belt guide member 16 and an upper surface of the elastic pressure roller 19 are contacted with pressure with the fixing belt 11 interposed therebetween, thereby forming a predetermined fixing nip N. That is, the lower surface of the ceramic heater 17 is arranged in contact with an inner peripheral surface of the fixing belt 11 having an endless belt shape.

In this fixing nip N, a recording medium P, which is an object to be heated in which an image is formed by an unfixed toner G, is nipped and conveyed at a conveying speed V. Thus, the toner image is heated and pressurized. As a result, the toner image is melted and mixed, and then cooled, and thus the toner image is fixed on the recording medium P.

(2) Fixing Device Using Fixing Roller

Figure 3:
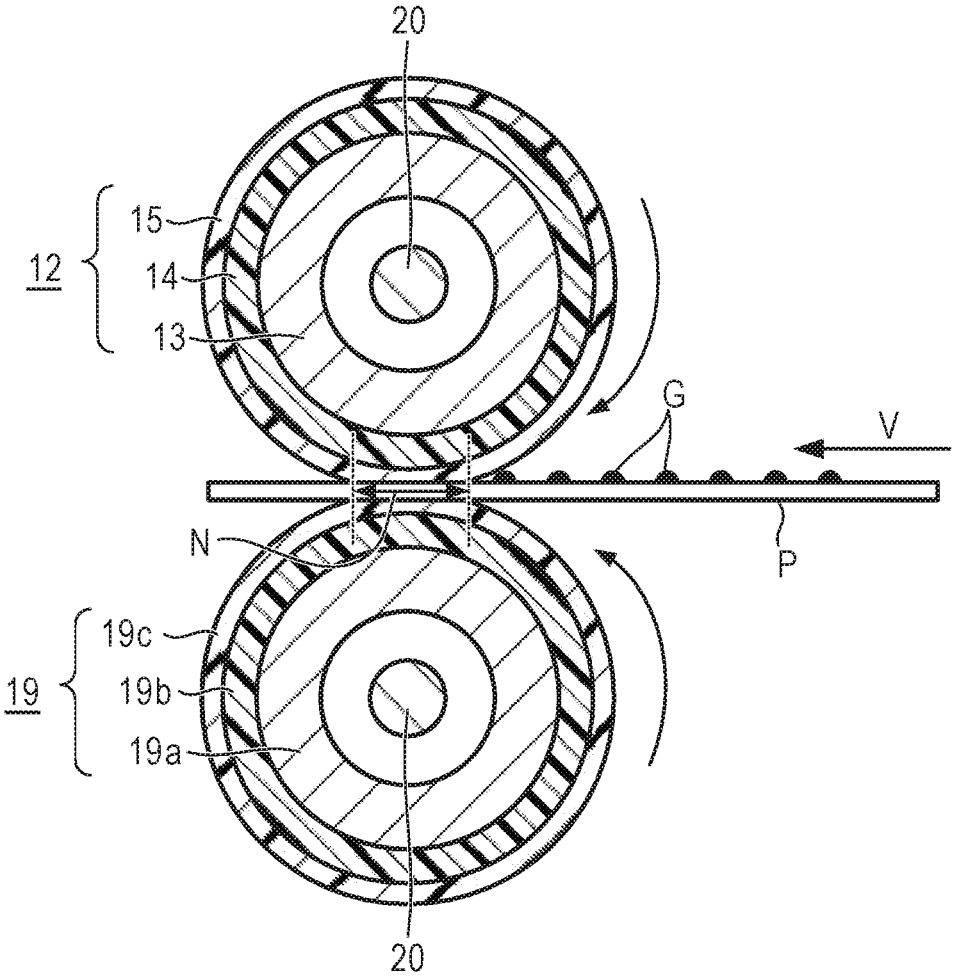
FIG. 3 is a schematic cross-sectional view of a fixing device using the fixing roller according to an embodiment of the present disclosure.

FIG. 3 is a transverse cross-sectional schematic view of an example of the fixing device using the fixing roller according to an embodiment of the present disclosure.

In this fixing device, the fixing roller 12 is a fixing member according to an embodiment of the present disclosure. In the fixing roller 12, the elastic layer 14 is formed on an outer peripheral surface of the substrate 13, and the release layer 15 is further formed on an outer side thereof.

The elastic pressure roller 19 as a pressure member is arranged so as to be opposed to the fixing roller 12, and two rollers are rotatably pressed by a pressurizing unit which is not shown, thereby forming a fixing nip N.

Inside the fixing roller 12 and the elastic pressure roller 19, a heater 20 as a heat source for supplying heat necessary for melting the unfixed toner G is installed. As the heater 20, a halogen heater is generally used. In some cases, a plurality of halogen heaters are installed inside according to the size of the recording medium P which is conveyed.

A rotating force is applied to the fixing roller 12 and the elastic pressure roller 19 through end portions of the substrate 13 and the stainless steel mandrel 19*a* by a unit which is not shown, and the rotation is controlled so that a moving speed on the surface of the fixing roller 12 is substantially equal to the conveying speed V. At this time, the rotating force may be applied to any one of the fixing roller 12 and the elastic pressure roller 19, and the other one may be rotated by the driven rotation, or the rotating force may be applied to both sides.

In the fixing nip N of the thus-formed fixing device, the recording medium P, which is an object to be heated in which the image is formed by the unfixed toner G, is nipped and conveyed. Thus, the toner image is heated and pressurized. As a result, the toner image is melted and mixed, and then cooled, and thus the toner image is fixed on the recording medium.

3. Image Forming Apparatus

As the image forming apparatus, there are a multifunction machine, a copying machine, a facsimile, a printer, and the like, using an electrophotographic method. Here, the overall constitution of the image forming apparatus is briefly described by using a color laser printer as an example.

Figure 4:
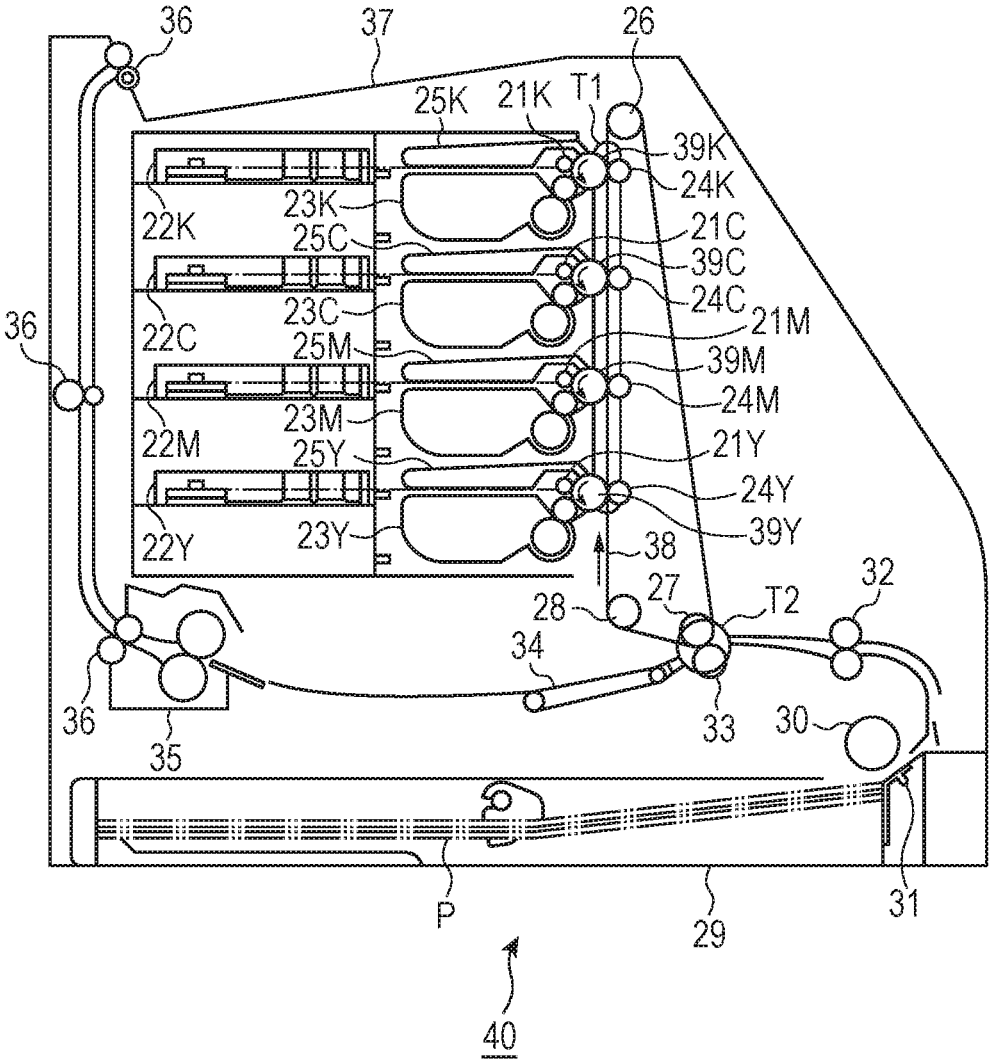
FIG. 4 is a schematic cross-sectional view of an image forming apparatus according to an embodiment of the present disclosure.

FIG. 4 is a schematic cross-sectional view of a color laser printer according to an embodiment of the present disclosure. The color laser printer 40 (hereinafter, referred to as "printer") shown in FIG. 4 has an image forming unit including an electrophotographic photosensitive drum (hereinafter, referred to as "photosensitive drum") which rotates at a constant speed for each color of yellow (Y), magenta (M), cyan (C), and black (K). In addition, the laser printer includes an intermediate transfer body 38 which holds a color image that is developed and multi-transferred in the image forming unit and further transfers the color image to the recording medium P fed from a feeding unit.

Photosensitive drums 39 (39Y, 39M, 39C, and 39K) are rotationally driven in a counterclockwise direction by a driving unit (not shown) as shown in FIG. 4.

In the periphery of the photosensitive drum 39, the following devices, and the like, are arranged sequentially according to a rotation direction thereof:

- charging device 21 (21Y, 21M, 21C, and 21K) which uniformly charges a surface of the photosensitive drum 39,
- scanner unit 22 (22Y, 22M, 22C, and 22K) which irradiates a laser beam based on image information and forms an electrostatic latent image on the photosensitive drum 39,
- developing unit 23 (23Y, 23M, 23C, and 23K) which develops a toner image by adhering the toner to the electrostatic latent image,
- primary transfer roller 24 (24Y, 24M, 24C, and 24K) which transfers the toner image on the photosensitive drum 39 through the intermediate transfer body 38 to a primary transfer portion T1, and
- cleaning unit 25 (25Y, 25M, 25C, and 25K) having a cleaning blade that removes a transfer residual toner remaining on the surface of the photosensitive drum 39 after transfer.

At the time of image formation, a belt-shaped intermediate transfer body 38 stretched around the rollers 26, 27, and 28 rotates, and each color toner image formed on each photosensitive drum 39 is superimposed on the intermediate transfer body 38 to be primarily transferred, thereby forming a color image.

The recording medium P is conveyed to a secondary transfer portion T2 by a conveying unit so as to be synchronized with the primary transfer with respect to the intermediate transfer body 38. The conveying unit has a feeding cassette 29 that accommodates a plurality of recording media P, a feeding roller 30, a separating pad 31, and a registration roller pair 32. At the time of image formation, the feeding roller 30 is rotated in accordance with an image forming operation to separate the recording medium P in the feeding cassette 29 one by one, and the recording medium P is conveyed to the secondary transfer portion T2 in synchronization with the image forming operation by the registration roller pair 32.

A movable secondary transfer roller 33 is arranged in the secondary transfer portion T2. The secondary transfer roller 33 is movable in a generally vertical direction. In addition, upon image transfer, the secondary transfer roller 33 is pressed by the intermediate transfer body 38 with a predetermined pressure through the recording medium P. Here, at the same time, a bias is applied to the secondary transfer roller 33 so that the toner image on the intermediate transfer body 38 is transferred to the recording medium P.

Since the intermediate transfer body 38 and the secondary transfer roller 33 are driven, the recording medium P sandwiched therebetween is conveyed at a predetermined conveying speed V in a direction of the left arrow shown in FIG. 4, and further conveyed to a fixing unit 35, which is the next step, by the conveying belt 34. In the fixing unit 35, heat and pressure are applied so that a transferred toner image is fixed on the recording medium P. The recording medium P is discharged onto a discharge tray 37 on an upper surface of the apparatus by a discharge roller pair 36.

Further, by applying the fixing device shown in FIGS. 2 and 3 to the fixing unit 35 of the electrophotographic image forming apparatus shown in FIG. 4, it is possible to obtain an image forming apparatus capable of providing a good fixing image.

According to an embodiment of the present disclosure, it is possible to obtain a fixing member which is difficult to generate hot offset of the toner even when the fixing member is used as a heating member of a thermal fixing device. Further, according to another embodiment of the present disclosure, it is possible to obtain a fixing device that contributes to formation of a high-quality electrophotographic image. Further, according to still another embodiment of the present disclosure, it is possible to obtain an electrophotographic image forming apparatus capable of forming a high-quality electrophotographic image.

EXAMPLE

Hereinafter, the present disclosure is specifically described with reference to Examples. In addition, the present disclosure is not limited to Examples below.

(Measurement of Surface Free Energy of Release Layer)

The surface free energy of the release layer can be calculated by a method of "Kitazaki and Hata" described in "Journal of the Adhesion Society of Japan", the Japan Society of Adhesion, 1972, Vol. 8, No. 3, p. 131-141. First, water, n-hexadecane, and diiodomethane were used as a standard liquid, and the contact angle of the release layer of the fixing belt was measured (measurement environment: temperature of 23° C. and relative humidity of 55%). Subsequently, the measurement result of each contact angle was used to determine the surface free energy from "expansion Fowkes formula" according to the description from "2. Extension of Fowkes formula" to "3. Surface tension of solid polymer and the components thereof" in p. 131 of "Journal of the Adhesion Society of Japan", the Japan Society of Adhesion, 1972, Vol. 8, No. 3, p. 131-141.

A contact angle meter (Product name: "DM-501" manufactured by Kyowa Interface Science, Inc.) was used for the measurement, and analysis software (Product name: "FAMAS" manufactured by Kyowa Interface Science Inc.) was used for surface free energy analysis.

(Measurement of Relaxation Time (T1−1) of Longitudinal Relaxation of $^{19}$F-NMR Spectrum at Temperature of 200° C. of PFPE in a Form of a Simple Substance)

First, the release layer together with the elastic layer were cut from the fixing member, and then the elastic layer was dissolved and removed with a resin dissolving agent such as "e-solve series" (manufactured by Kaneko Chemical Co., Ltd.), and only the release layer was taken out. Then, the collected release layer was immersed in NOVEC7300 (Product name; manufactured by 3M Company) and placed at a temperature of 25° C. for 24 hours.

Next, the solvent from which the PFPE is eluted and the release layer were separated by filtration, and the solvent was removed from the solvent from which the PFPE is eluted by using an evaporator from the obtained filtrate, thereby obtaining PFPE.

The obtained sample was used to determine (T1−1) by the above method.

(Measurement of Relaxation Time (T1−2) of Longitudinal Relaxation of $^{19}$F-NMR Spectrum)

Only the part of the release layer was scraped off from the fixing member belt and the obtained sample was used to determine (T1−2) by the above method.

<Preparation of PFA>

PFA and PFPE described in Tables 1 and 2 were manufactured as PFA and PFPE used for producing a fluororesin tube for forming a release layer.

TABLE 1

| PFA type | |
|---|---|
| PFA-1 | "451 HP-J" (Du Pont Mitsui Fluorochemicals Co., Ltd.)<br>*Ratio of PAVE = 1.2 mol % |
| PFA-2 | "959 HP-Plus" (Du Pont Mitsui Fluorochemicals Co., Ltd.)<br>*Ratio of PAVE = 4.3 mol % |

TABLE 2

| PFPE type | |
|---|---|
| PFPE-1 | "Krytox GPL107" (Product manufactured by Chemours Company)<br>*T1-1 = 2.3 sec |
| PFPE-2 | "Demnum S200" (Product manufactured by Daikin Industries, Ltd.)<br>*T1-1 = 2.2 sec |
| PFPE-3 | "Fomblin M60" (Product manufactured by Solvay Japan, Ltd.)<br>*T1-1 = 3.8 sec |
| PFPE-4 | "Krytox VPF16256" (Product manufactured by Chemours Company)<br>*T1-1 = 2.2 sec |
| PFPE-5 | "Krytox XHT-750" (Product manufactured by Chemours Company)<br>*T1-1 = 2.2 sec |
| PFPE-6 | "Krytox XHT-1000" (Product manufactured by Chemours Company)<br>*T1-1 = 2.1 sec |

Example 1

Manufacture of Release Layer

PFA-1 and PFPE-1 were mixed and stirred in a stirrer so that a ratio of the mass of PFPE to the total mass of PFA and PFPE (hereinafter, referred to as "PFPE/(PFA+PFPE)") became 0.10 to obtain a mixture of PFA and PFPE.

The mixture was injected into a twin-screw extruder, kneaded and extruded under conditions in which a screw diameter is 46 mm, a screw rotation speed is 180 rpm, and a cylinder temperature is 350° C. to 420° C. PFA/PFPE pellets were prepared by cooling and cutting the extruded composition.

The thus-prepared PFA/PFPE pellets were injected into a single screw extruder having a screw diameter of 40 mm, extruded into a tube shape vertically downward while melting the PFA/PFPE pellets at an extrusion rate of 50 g/min and a cylinder temperature of 320° C. to 370° C., and the tube was stretched at a tensile rate of 3.0 m/min to produce a fluororesin tube for a release layer having a thickness of 50 μm. In addition, a mandrel was adjusted so that an inner diameter of the fluororesin tube was 30 mm.

Measurement sample 1 was taken from the obtained fluororesin tube and the relaxation time (T1–2) of the peak derived from PFPE at a temperature of 200° C. was measured according to the above-described method.

(Manufacture of Substrate and Elastic Layer)

As a substrate, a substrate having an endless belt shape made of electroformed nickel having an inner diameter of 30 mm, a width of 400 mm, and a thickness of 40 μm was prepared. Primer treatment was applied to an outer peripheral surface of this substrate.

As a raw material for forming an elastic layer, an addition-curing type liquid silicone rubber without including a filler (Product name: "SE 1886" manufactured by Dow Corning Toray Co., Ltd.) was prepared. To 61 parts by volume of the liquid silicone rubber, 38 parts by volume of spherical alumina (Product name: "Alunabeads CB-A30S" manufactured by Showa Denko K.K.) as a spherical filler and 1 part by volume of gas phase method carbon fiber (Product name: "VGCF-S" manufactured by Showa Denko K.K., aspect ratio=100, average fiber length=10 μm) as a release filler were added. Thus, an addition-curing type silicone rubber composition for forming the elastic layer was prepared. These were applied on the outer peripheral surface of the above substrate by a ring coating method and heated at a temperature of 200° C. for 4 hours to crosslink a layer of the addition-curing type silicone rubber composition, thereby forming an elastic layer having a thickness of 300 μm.

The substrate on which the elastic layer was formed was rotated at a moving speed of 20 mm/sec in a circumferential direction, and a surface of the elastic layer was irradiated with UV rays in the atmosphere using an ultraviolet lamp in which a separation distance is 10 mm from the surface of the elastic layer. As the ultraviolet lamp, a low pressure mercury ultraviolet lamp (Product name: GLQ500US/11, manufactured by Toshiba Lighting and Technology Corporation) was used to irradiate an irradiated surface so that a cumulative light amount of the wavelength of 185 nm is 800 mJ/cm$^2$.

(Manufacture of Fixing Belt)

Subsequently, onto the surface of the elastic layer, an addition-curing type silicone rubber adhesive (Product name: SE1819CV, a mixture of equal amounts of "Solution A" and "Solution B" manufactured by Dow Corning Toray Co., Ltd.) was applied almost uniformly so that a thickness is about 20 μm.

Next, the fluororesin tube manufactured as above was covered as the release layer, and a surface of the belt was uniformly handled over the fluororesin tube, and thus an excessive adhesive was handled between the elastic layer and the fluororesin tube.

Then, in an electric furnace set at a temperature of 200° C., an elastic layer and a substrate coated with the fluororesin tube on a peripheral surface of the elastic layer were placed and heated for 1 hour to cure the adhesive so that the fluororesin tube was adhered onto the elastic layer, and then both ends were cut to obtain a fixing belt No. 1 having a width of 343 mm. The obtained fixing belt No. 1 was provided for the following evaluation.

(Evaluation 1: Evaluation of Paper Feeding Durability)

A fixing belt No. 1 was mounted as a fixing belt of an electrophotographic image forming apparatus (Product name: imageRUNNER-ADVANCE C5051; manufactured by Canon Inc.). Further, the fixing condition was changed so that a surface temperature of the fixing belt was 20° C. higher than the general set temperature. This electrophotographic image forming apparatus was used to feed a hammermill paper (International paper company, size: A4, basis weight 75 g/m$^2$) into the apparatus. In addition, the surface free energy of the surface of the release layer of the fixing belt was measured after passing the 1000th sheet and the 10000th sheet.

Examples 2 to 12

Each fluororesin tube was manufactured in the same manner as in the fluororesin tube according to Example 1 except that at least one of PFA type, PFPE type, and the mixing ratio (PFPE/(PFA+PFPE)) of PFA and PFPE used for producing the fluororesin tube was changed as indicated in Table 3. For each fluororesin tube, the relaxation time (T1–2) of PFPE was measured in the same manner as in Example 1.

Further, the fixing belts according to Examples 2 to 12 were manufactured in the same manner as in the fixing belt according to Example 1 except that the fluororesin tubes according to Examples 2 to 12 were used instead of the fluororesin tubes according to Example 1, and provided for Evaluation 1.

TABLE 3

| | | PFA type | PFPE type | PFA/(PFA + PFPE) |
|---|---|---|---|---|
| Example | 1 | PFA-1 | PFPE-1 | 0.100 |
| | 2 | PFA-1 | PFPE-2 | 0.100 |
| | 3 | PFA-1 | PFPE-3 | 0.100 |
| | 4 | PFA-2 | PFPE-1 | 0.100 |
| | 5 | PFA-2 | PFPE-2 | 0.100 |
| | 6 | PFA-2 | PFPE-3 | 0.100 |
| | 7 | PFA-2 | PFPE-1 | 0.012 |
| | 8 | PFA-2 | PFPE-1 | 0.051 |
| | 9 | PFA-2 | PFPE-1 | 0.290 |
| | 10 | PFA-2 | PFPE-4 | 0.200 |
| | 11 | PFA-2 | PFPE-5 | 0.200 |
| | 12 | PFA-2 | PFPE-6 | 0.200 |

Comparative Example 1

A substrate and an elastic layer were manufactured in the same manner as in Example 1, the surface of the elastic layer was treated with excimer UV rays, and then a primer (Product name: EK-1909S21L, manufactured by Daikin Industries, Ltd.) was uniformly spray coated to have a thickness of 2 μm, and dried.

Next, two spray guns were prepared. One spray gun was filled with an aqueous dispersion coating material of PFA particles (Product name: AW-5000L, manufactured by Daikin Industries, Ltd., melting point of 300° C., and glass transition point of 90° C.). The other spray gun was filled with PFPE-3. Further, using these spray guns, an aqueous dispersion coating material of PFA and PFPE were coated on the surface of the elastic layer to form a coating film having a thickness of 20 μm including PFA particles and PFPE. Here, a coating amount of the spray gun was adjusted so that a mass ratio of PFPE-3 was 0.1 based on the weight of PFA solid content in the coating film.

Subsequently, the coating film was heated at a temperature of 350° C. for 15 minutes, and the PFA particles in the coating film were melted to form a release layer, thereby obtaining a fixing belt according to Comparative Example 1. With respect to the release layer of the obtained fixing belt, the relaxation time (T1–2) of PFPE was measured in the same manner as in Example 1.

Further, the fixing belt according to Comparative Example 1 was provided for Evaluation 1.

Each value of (T1–1) and (T1–2) and [(T1–1)–(T1–2)]/(T1–1) are shown in Table 4 with respect to Examples 1 to 12 and Comparative Example 1.

Further, results of Evaluation 1 with respect to each of the fixing belts according to Examples 1 to 12 and Comparative Example 1 are shown in Table 5.

TABLE 4

| | | T1-1 (seconds) | T1-2 (seconds) | [(T1-1) − (T1-2)]/(T1-1) |
|---|---|---|---|---|
| Example | 1 | 2.3 | 1.5 | 0.3 |
| | 2 | 2.2 | 1.9 | 0.1 |
| | 3 | 3.8 | 3.5 | 0.1 |
| | 4 | 2.3 | 1.3 | 0.4 |
| | 5 | 2.2 | 1.7 | 0.2 |
| | 6 | 3.8 | 3.3 | 0.1 |
| | 7 | 2.3 | 1.2 | 0.5 |
| | 8 | 2.3 | 1.3 | 0.4 |
| | 9 | 2.3 | 1.6 | 0.3 |
| | 10 | 2.2 | 1.4 | 0.4 |
| | 11 | 2.2 | 1.4 | 0.4 |
| | 12 | 2.1 | 1.3 | 0.4 |
| Comparative Example 1 | | 3.8 | 3.7 | 0.0 |

TABLE 5

| | Surface free energy before paper feeding [mJ/m$^2$] | After paper feeding 1000 sheets Surface free energy [mJ/m$^2$] | After paper feeding 10000 sheets Surface free energy [mJ/m$^2$] |
|---|---|---|---|
| Example 1 | 13.1 | 13.4 | 13.9 |
| Example 2 | 13.2 | 13.5 | 13.8 |
| Example 3 | 13.0 | 14.0 | 14.8 |
| Example 4 | 12.8 | 13.0 | 13.0 |
| Example 5 | 13.4 | 13.8 | 13.9 |
| Example 6 | 13.1 | 13.8 | 14.8 |
| Example 7 | 13.6 | 13.9 | 14.2 |
| Example 8 | 13.5 | 13.7 | 13.8 |
| Example 9 | 13.1 | 13.1 | 13.1 |
| Example 10 | 13.4 | 13.5 | 13.6 |
| Example 11 | 13.3 | 13.6 | 13.6 |
| Example 12 | 13.8 | 13.8 | 13.9 |
| Comparative Example 1 | 13.0 | 15.5 | 17.5 |

By determining the relaxation time T1 of the peak derived from PFPE in the release layer in the NMR spectrum at 200° C. to be 0.5 or more and 3.5 or less, the surface free energy could be maintained to 15 mJ/m$^2$ or less even when a plurality of images were continuously fixed. By determining the relaxation time T1 of the peak derived from PFPE in the release layer in the NMR spectrum at 200° C. to be 0.5 or more and 2.0 or less, the difference in surface free energy between before and after the paper feeding was small as 1.0 or less even when images were continuously fixed on 10,000 sheets. As a result, it is considered that PFPE maintainability is high, and toner releasability can be maintained for a longer period of time. Further, when comparing Examples 1 and 4 and Examples 2 and 5, as PAVE which is a copolymerization component in PFA was as large as 4.3 mol %, a difference in surface free energy between before and after paper feeding could be small as 0.5 or less.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-055191, filed Mar. 22, 2018, and Japanese Patent Application No. 2019-028560, filed Feb. 20, 2019, which are hereby incorporated by reference herein in their entirety.

What is claimed is:

1. A fixing member for electrophotography, comprising:

a substrate; and a release layer as a surface layer, wherein the release layer includes:

a first fluororesin; and a second fluororesin, wherein the first fluororesin is perfluoropolyether (PFPE), wherein the second fluororesin is at least one selected from a tetrafluoroethylene-perfluoroalkyl vinyl ether copolymer (PFA) and a tetrafluoroethylene-hexafluoropropylene copolymer (FEP), and wherein, when a longitudinal relaxation time of PFPE in a form of a simple substance derived from a $^{19}$F-NMR measured at a temperature of 200° C. is defined as T1–1, and a longitudinal relaxation time of PFPE contained in the release layer derived from a $^{19}$F-NMR of the release layer measured at a temperature of 200° C. is defined as T1–2, T1–1 and T1–2 satisfy a relationship represented by equation (1):

$$[(T1-1)-(T1-2)]/(T1-1) \geq 0.1 \quad \text{equation (1).}$$

2. The fixing member according to claim 1, wherein the longitudinal relaxation time T1–2 is 0.5 seconds to 3.5 seconds.

3. The fixing member according to claim 1, wherein the longitudinal relaxation time T1–2 is 0.5 seconds to 2.0 seconds.

4. The fixing member according to claim 1, wherein a content of the first fluororesin in the release layer is 1 mass % to 30 mass % with respect to a total amount of the first fluororesin and the second fluororesin.

5. The fixing member according to claim 1, wherein a content of the first fluororesin in the release layer is 3 mass % to 20 mass % with respect to a total amount of the first fluororesin and the second fluororesin.

6. The fixing member according to claim 1, wherein the perfluoropolyether has at least one structure selected from structures represented by structural formulas (1) and (2):

structural sormula (1)

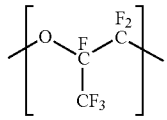

structural formula (2)

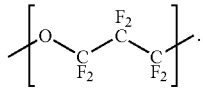

7. The fixing member according to claim 1, wherein the perfluoropolyether has at least one structure selected from structures represented by structural formulas (3) to (5):

structural formula (3)

$$F_3C-CF_2-CF_2-O-(CF_2-CF_2-CF_2-O)_n-CF_2-CF_3$$

structural formula (4)

$$F_3C-CF_2-CF_2-O-(CF(CF_3)-CF_2-O)_n-CF_2-CF_3$$

structural formula (5)

$$F_3C-(O-CF_2-CF_2)_n(O-CF_2)_m-O-CF_3.$$

8. An electrophotographic fixing device comprising a fixing member and a heating unit of the fixing member, wherein the fixing member is an electrophotographic fixing member including:

a substrate; and a release layer as a surface layer, wherein the release layer includes:

a first fluororesin; and a second fluororesin, wherein the first fluororesin is perfluoropolyether (PFPE), wherein the second fluororesin is at least one selected from a tetrafluoroethylene-perfluoroalkyl vinyl ether copolymer (PFA), and a tetrafluoroethylene-hexafluoropropylene copolymer (FEP), and wherein, when a longitudinal relaxation time of PFPE in a form of a simple substance derived from a $^{19}$F-NMR measured at a temperature of 200° C. is defined as T1–1, and a longitudinal relaxation time of PFPE contained in the release layer derived from a $^{19}$F-NMR of the release layer measured at a temperature of 200° C. is defined as T1–2, T1–1 and T1–2 satisfy a relationship represented by equation (1):

$$[(T1-1)-(T1-2)]/(T1-1)\geq 0.1 \quad \text{equation (1).}$$

9. The fixing device according to claim 8, wherein the fixing member is a fixing belt having an endless belt shape, and the heating unit includes a heater arranged in contact with an inner peripheral surface of the fixing belt.

10. An electrophotographic image forming apparatus comprising a fixing device, wherein the fixing device includes an electrophotographic fixing member, wherein the fixing member is an electrophotographic fixing member including:

a substrate; and a release layer as a surface layer, wherein the release layer includes:

a first fluororesin; and a second fluororesin, wherein the first fluororesin is perfluoropolyether (PFPE), wherein the second fluororesin is at least one selected from a tetrafluoroethylene-perfluoroalkyl vinyl ether copolymer (PFA) and a tetrafluoroethylene-hexafluoropropylene copolymer (FEP), and wherein, when a longitudinal relaxation time of PFPE in a form of a simple substance derived from a $^{19}$F-NMR measured at a temperature of 200° C. is defined as T1–1, and a longitudinal relaxation time of PFPE contained in the release layer derived from a $^{19}$F-NMR of the release layer measured at a temperature of 200° C. is defined as T1–2, T1–1 and T1–2 satisfy a relationship represented by equation (1) below:

$$[(T1-1)-(T1-2)]/(T1-1)\geq 0.1 \quad \text{equation (1).}$$

* * * * *